US005491856A

United States Patent [19]

Legg

[11] Patent Number: 5,491,856

[45] Date of Patent: Feb. 20, 1996

[54] FOLDABLE MULTIPLE FUNCTION TOOL

[76] Inventor: Larry K. Legg, 925 Eaglewood Dr., Willoughby, Ohio 44094

[21] Appl. No.: 268,261

[22] Filed: Jun. 29, 1994

[51] Int. Cl.[6] ..... B25F 1/04

[52] U.S. Cl. ..... 7/128; 7/106; 81/427.5

[58] Field of Search ..... 7/106, 127–131; 81/415, 427.5, 318, 324

[56] References Cited

U.S. PATENT DOCUMENTS

| | | | |
|---|---|---|---|
| 1,461,270 | 7/1923 | Garrison . | |
| 3,798,687 | 3/1974 | Stevens . | |
| 3,858,258 | 1/1975 | Stevens . | |
| 4,208,749 | 6/1980 | Hermann et al. | 7/106 |
| 4,238,862 | 12/1980 | Leatherman . | |
| 4,648,145 | 3/1987 | Miceli . | |
| 4,744,272 | 5/1988 | Leatherman . | |
| 5,062,173 | 11/1991 | Collins et al. . | |
| 5,119,520 | 6/1992 | Finn . | |
| 5,267,366 | 12/1993 | Frazer | 7/128 |

*Primary Examiner*—James G. Smith
*Attorney, Agent, or Firm*—Tarolli, Sundheim & Covell

[57] ABSTRACT

A foldable multiple function tool is presented herein. The tool includes a pair of members each having a gripping jaw at one end thereof and a tang at the opposite end thereof. A first pivot member pivotally interconnects the members together for pivotal movement about a first axis intermediate the respective ends of the members for movement between a jaw closed position and a jaw open position with the pivotal movement being about a first axis. A pair of handles are connected to the tangs for pivotal movement about second and third pivot axes with each handle being pivotally displacable between a foldable position and an extended position. The handles are spaced apart by a distance sufficient that when the handles are in their folded positions they receive therebetween the gripping jaws, when in a closed position with each handle serving to block pivotal movement of one of the jaws toward a jaw open position.

10 Claims, 3 Drawing Sheets

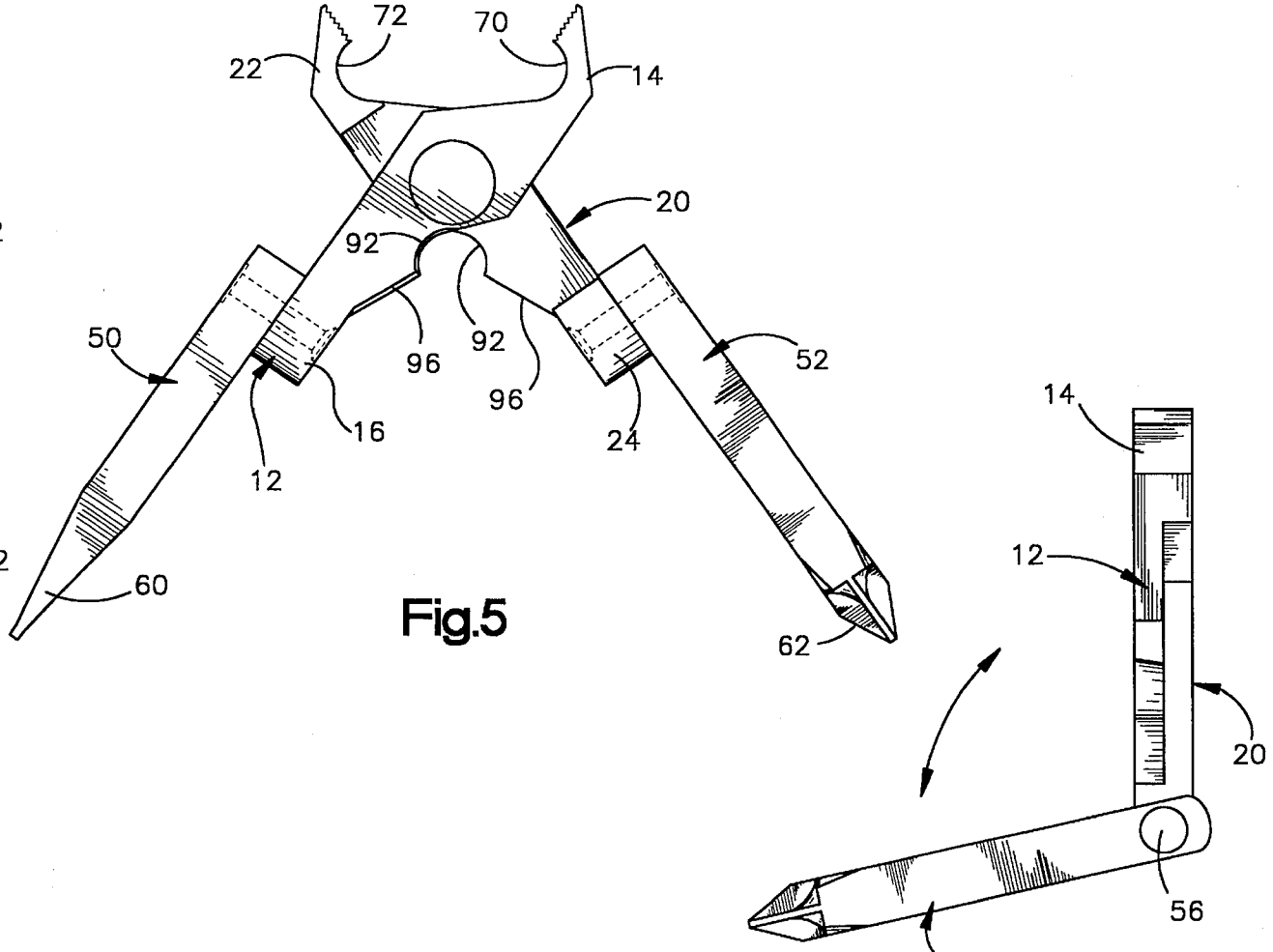
Fig.6
Fig.5
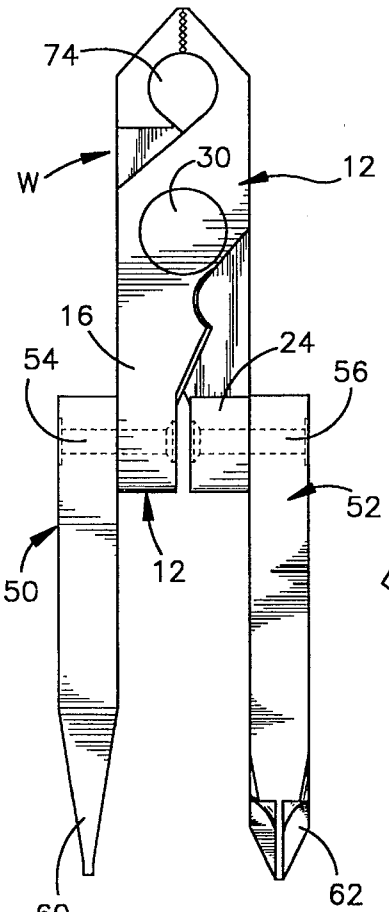
Fig.4

FOLDABLE MULTIPLE FUNCTION TOOL

FIELD OF THE INVENTION

The present invention relates to the art of foldable multiple function tools and, more particularly, to an improved tool having means for locking the tool when in a folded condition.

DESCRIPTION OF THE PRIOR ART

Foldable multiple function tools are known in the prior art. Examples of such prior art are found in the U.S. patents to T. S. Leatherman U.S. Pat. Nos. 4,744,272 and 4,238,862, as well as in the U.S. patent to M. C. Collins et al. U.S. Pat. No. 5,062,173.

The Leatherman patents, supra, are directed toward a foldable tool having a pair gripping jaws each including a gripping portion and a tang portion with the jaws being pivotally connected together intermediate their ends for pivotal movement about a first axis. A first handle is pivotally mounted to one of the tangs for pivotal movement about a second axis parallel to the first axis, and a second handle is pivotally mounted to the other tang for pivotal movement about a third axis parallel to the first and second axes. Each of the handles has a channel formed therein so that when the handles are pivoted about the second and third axes they will receive the gripping jaws therein.

Another form of a foldable multiple function tool takes the form of that shown in the patent to M. C. Collins, supra, which is similar to that of the Leatherman patents discussed above but employing handles which are pivotally mounted for respective pivotal movement about a second axis and a third axis which are perpendicular to the first axis. In a folded condition, the gripping jaws are closed and are located between the handles. The handles do not provide a means for preventing the gripping jaws from opening. A separate latching mechanism is provided for holding the gripping jaws in a closed position.

The present invention is directed toward a more simplified structure including means for holding the jaws in a closed position without the requirement of additional parts. The construction of the gripping jaws together with associated handles is such that the gripping jaws are locked in a closed position when at least one of the handles is in its folded position.

SUMMARY OF THE INVENTION

In accordance with the present invention, there is provided a foldable multiple function tool. The tool includes a first elongated member having a right side gripping jaw at one end thereof and a left side tang at the opposite end thereof. A second elongated member is provided having a left side gripping jaw at one end thereof and a right side tang at the opposite end thereof. A first pivot member serves to pivotally connect the first and second members together for pivotal movement about a first axis located intermediate the respective ends of the two members so that the two members may be pivoted about the first axis between a jaw closed position at which the jaws are adjacent each other and a jaw open position at which the jaws are spaced from each other. An elongated left handle and an elongated right handle are provided with each having a first end and a second end. A second pivot member serves to pivotally connect the first end of the left handle to the left side tang for pivotal movement about a second axis perpendicular to the first axis between a folded position and an extended position. A third pivot member serves to pivotally connect the first end of the right handle to the right side tang for pivotal movement about a third axis perpendicular to the first axis and parallel to the second axis between a folded position and an extended position. The handles are spaced apart for pivotal movement in parallel planes which are spaced apart from each other sufficient that when the handles are in their respective folded positions they receive therebetween the left side and right side gripping jaws when the gripping jaws are in a closed position and such that each handle serves to block pivotal movement of one of the jaws toward a jaw open position.

In accordance with a more limited aspect of the present invention the left side and right side jaws taken together, and when in a closed position, are of a width corresponding with the spacing between the parallel planes.

In accordance with a still further aspect of the invention the left side jaw and the right side jaw have cooperating recesses formed therein so that when the jaws are in a closed condition the recesses define an opening for receiving and retaining a key ring or the like.

The foregoing and other objects of the invention will become more readily apparent from the following description of the preferred embodiment of the invention taken in conjunction with the accompanying drawings which are a part hereof and wherein:

BRIEF DESCRIPTION OF THE DRAWINGS

FIG. 4 is a view similar to that of FIGS. 1, 2, and 3 but showing both handles in extended positions;

FIG. 5 is a view similar to that of FIG. 4 but showing the handles pivoted apart from each other so that the gripping jaws are spaced from each other;

FIG. 6 is a side view taken generally along line 6—6 looking in the direction of the arrows in FIG. 1 but showing the right, side handle being pivoted to a position between a folded position and an extended position;

DESCRIPTION OF PREFERRED EMBODIMENT

Figure 3:
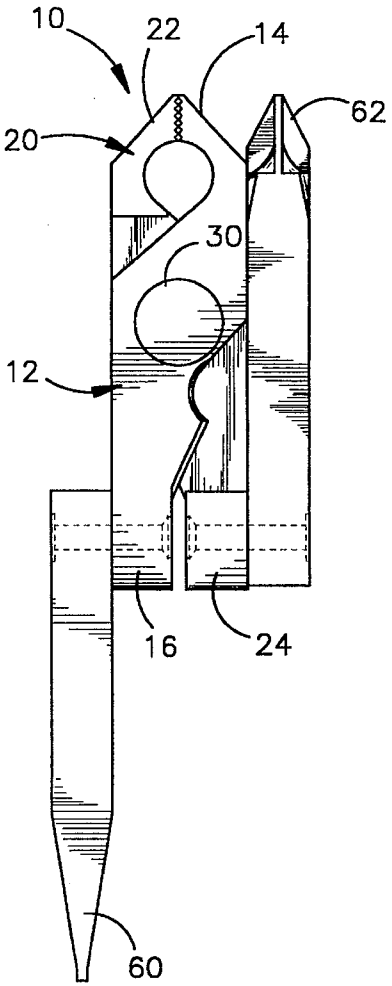
FIG. 3 is a view similar to that of FIG. 1, but showing the left handle in an extended position with the right handle being in a folded position.

Reference is now made to the drawings wherein the showings are for the purpose of illustrating a preferred embodiment of the invention only, and not for the purpose of limiting the same. The figures illustrate a foldable multiple function tool 10 constructed in accordance with the present invention. The tool 10 is preferably constructed of rigid material sufficient for performing the various functions to be described herein. The material may take the form of metal although some non-metal materials could be employed. As shown, the tool includes a first elongated member 12 having a right side gripping jaw 14 at one end thereof and a left side tang 16 at the opposite end thereof. The tool also includes a second elongated member 20 having a left side gripping jaw 22 at one end thereof and a right side tang 24 at the opposite end thereof. A first pivot pin 30 extends through cooperating apertures in the members 12 and 20 for providing a pivotal connection therebetween. This permits members 12 and 20 to pivot about a first axis extending through the pivot pin 30. The pivot axis is located intermediate the respective ends of the members. Thus the members may be pivoted about the pivot member 30 between a jaw closed position as is show in FIGS. 1–4 at which the jaws engage each other and a jaw open position as is shown in FIG. 5 at which the jaws are spaced from each other. The pivot pin 30 may have an enlarged head at one end and it may be deformed at the other end so as to flare outwardly to prevent members 12 and 20 from disconnecting from each other.

The tool also includes a pair of handles including an elongated left handle 50 and an elongated right handle 52. The left handle 50 is pivotally mounted at one end thereof to the left side tang 16 of member 12 by means of a pivot pin 54 and which may be constructed as in the case of pivot pin 30 discussed hereinabove. It is noted however, that pin 54 provides pivotal movement of handle 50 about a second axis which is perpendicular to the axis defined by pivot pin 30. This permits pivotal movement of handle 50 about the second axis between a folded position as shown in FIG. 1 and an extended position as shown in FIG. 4.

Figure 1:
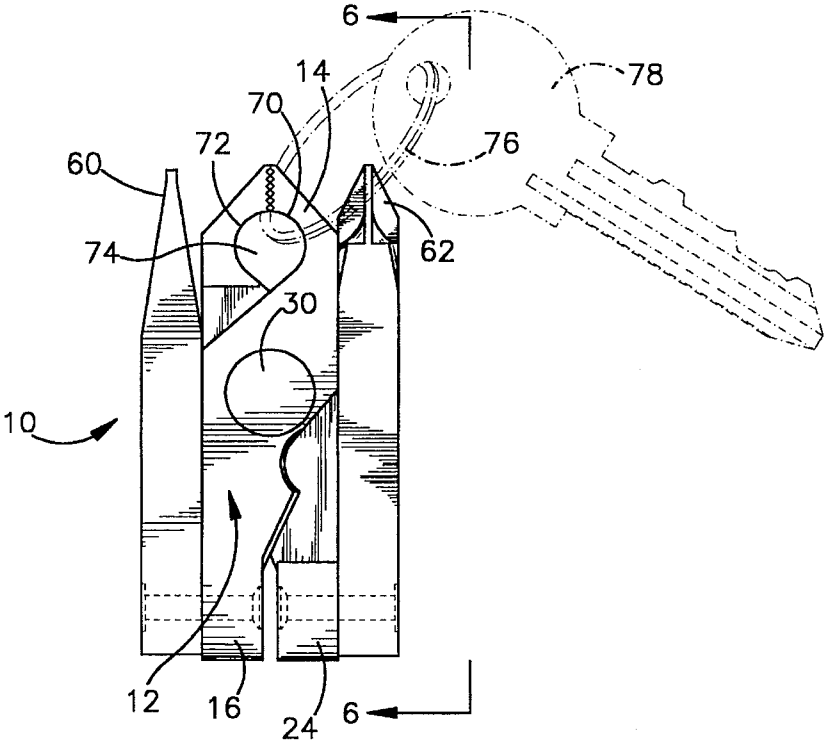
FIG. 1 is an elevational view illustrating one embodiment of thee tool herein with both handles in a folded position.

In a similar manner, the right handle 52 is pivotally mounted at one end thereof to the right side tang 24 by means of another pivot pin 56 constructed in the same manner as pivot pin 54 to provide pivotal movement about a third pivot axis between a folded position as shown in FIG. 1 and a fully extended position as shown in FIG. 4.

It is to be noted that this third pivot axis of pivot pin 56 is parallel to the pivot axis of pin 54 and both are perpendicular to the pivot axis of pivot pin 30.

As noted above, handle 50 is pivoted at one end to tang 16. The other end of handle 50 is formed as a screwdriver 60 of the type normally employed for driving a typical flat head screw having a single groove in the head thereof. Handle 52 is also provided with a screwdriver taking the form of a Phillips screwdriver 62 at its free end for use in driving Phillips type screws. These screwdrivers may be formed by machine or molding or casting as desired.

The handles 50 and 52 are essentially rectangular in cross-section throughout the bulk of their lengths. These handles are spaced apart, as is shown in FIG. 4, for pivotal movement in parallel planes. These parallel planes are spaced from each other by a distance sufficient that when the handles are in their respective folded positions, as shown in FIG. 1, they receive therebetween the gripping jaws 14 and 22 when the gripping jaws are in a closed position. In this closed position, each handle serves to block pivotal movement of one of the jaws towards a jaw open position. The jaws, when in a closed position, have a width w which corresponds with the width or spacing between inner or facing surfaces of handles 50 and 52. The width is just slightly less than the spacing between the handles so as to permit the handles to be displaced from their extended position to the folded position, as is shown in FIG. 1.

Figure 2:
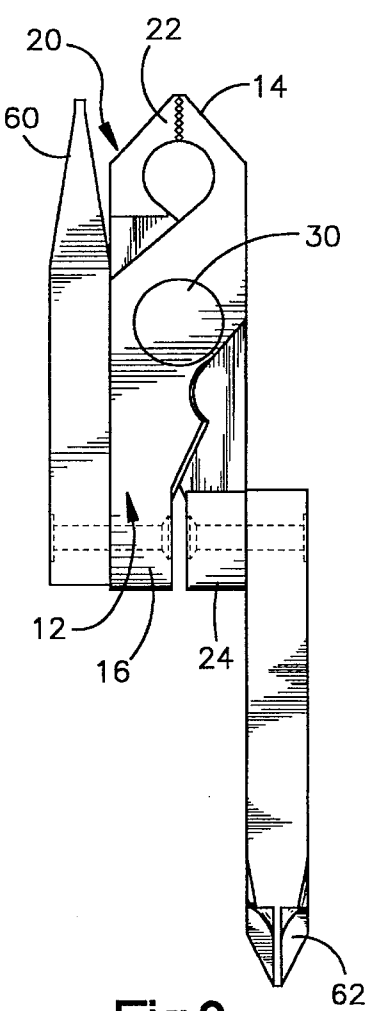
FIG. 2 is a view similar to that of FIG. 1 but showing the right handle in an extended position.

The gripping jaws 14 and 22 are respectively provided with arcuate shaped recesses 70 and 72 on the inner surfaces which face toward each other. When the gripping jaws are closed, as is seen in FIGS. 1–4, these arcuate shaped recesses 70 and 72 cooperate to define a circular shaped aperture 74. This circular shaped aperture is sufficient to receive, when the jaws are open, a key ring 76 which carries a key 78. When at least one of the legs is in its folded position, as shown in FIGS. 1, 2 and 3, the jaws are locked and prevented from opening toward their open position, as shown in FIG. 5. This ensures that the key ring 76 with its key will be held in place with the key ring extending into the aperture 74. The handles 50 and 52 are held in place in an extended or folded position by friction between the handles and the tangs.

Figure 7:
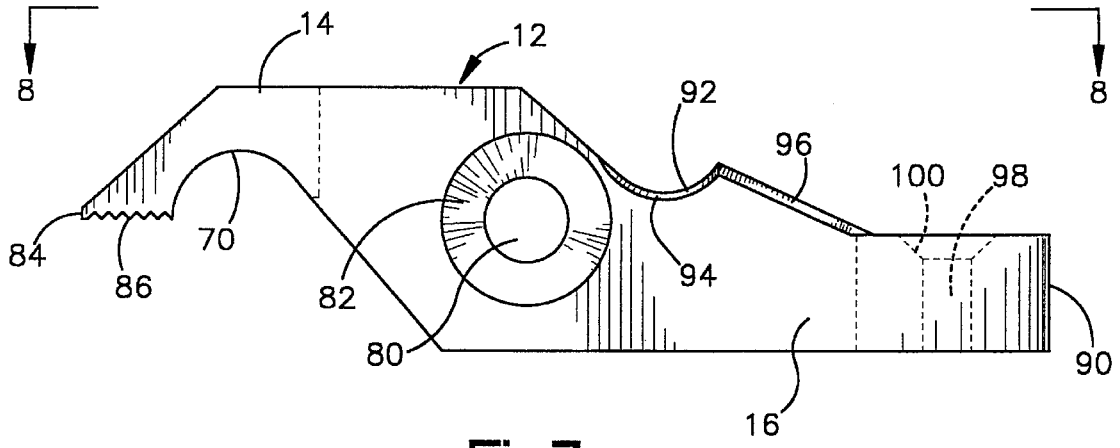
FIG. 7 is an elevational view of an elongated member having a gripping jaw at one end and a tang at the opposite end but showing the construction in greater detail than that of FIGS. 1–6; and, FIG. 8 is a view taken along lines 8—8 looking in the direction of the arrows in FIG. 7.
Figure 8:
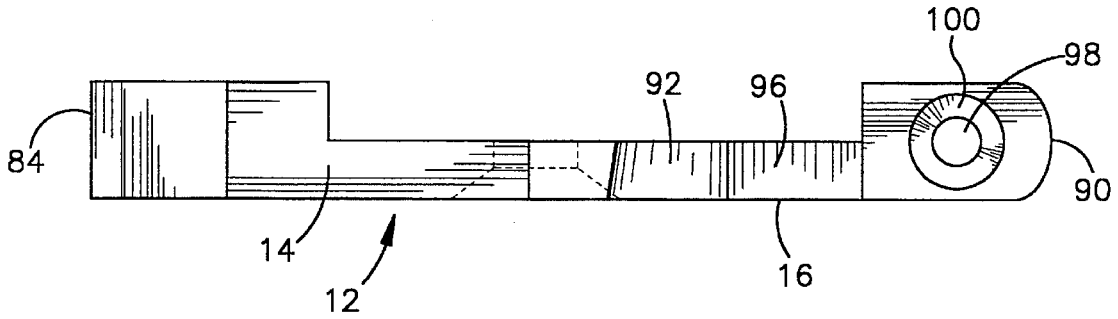

Reference is now made to FIGS. 7 and 8 which illustrate an enlarged version of the first elongated member 12. It is to be understood that the second elongated member 20 is constructed in the same manner. As noted herein, member 12 includes a gripping jaw 14 at one end thereof and a tang 16 at the opposite end thereof. Intermediate jaw 14 and tang 16, member 12 is provided with an aperture 80 having a flared annular portion 82. Aperture 80 receives the shank portion of pivot pin 30, whereas the annular portion 82 receives the head of the pivot pin or the flared end thereof. Jaw 14 extends from the aperture 80 to a distal end 84. The jaw is provided with a gripping surface 86 which is serrated and which faces a corresponding surface of jaw 22 during operation. The serrated surface 86 assists in the gripping action of an object.

Tang 16 extends from aperture 80 in an opposite direction toward the proximal end 90 of member 12. Tang 16 is provided with an arcuate shaped notch 92 which is angled at 94 to provide an arcuate shaped cutting edge. The notch 92 in tang 16 cooperates with a facing notch 92 in tang 24 to provide a means for gripping and stripping insulated wires and/or for cutting wires and the like.

Extending from notch 92 the tang 16 is also provided with an angled surface which provides a sharp edge or cutting blade 96. The cutting blade 96 on tang 12 cooperates with a blade 96 on tang 24 to provide a scissor type tool for cutting objects and the like.

Adjacent the proximal end 90 of tang 16 there is provided an aperture 98 having a flared edge 100. This aperture 98 serves to receive the pivot post 54 (or the pivot post 56) for fastening the member 12 to handle 50 (or fastening member 20 to handle 52). The flared or angled portion 100 serves to receive the head of the pivot pin.

Whereas the invention has been described in conjunction with a preferred embodiment is to be appreciated that various modifications may be made without departing from the spirit and scope of the invention as defined in the appended claims.

Having described the invention, the following is claimed:

1. A foldable multiple function tool, comprising:

a first elongated member having a right side gripping jaw at one end thereof and a left side tang at the opposite end thereof;

a second elongated member having a left side gripping jaw at one end thereof and a right side tang at the opposite end thereof;

first pivot means for pivotally connecting said first and second members together for pivotal movement about a first axis located intermediate the respective ends of said members so that said members may be pivoted about said first axis between a jaw closed position at which said jaws are adjacent each other and a jaw open position at which said jaws are spaced from each other;

an elongated left handle and an elongated right handle each having a first end and a second end;

second pivot means for pivotally connecting said first end of said left handle to said left side tang for pivotal movement about a second axis perpendicular to said first axis between a folded position and an extended position only when said first and second members are in said jaw closed position;

third pivot means for pivotally connecting said first end of said right handle to said right side tang for pivotal movement about a third axis perpendicular to said first axis and parallel to said second axis between a folded position and an extended position only when said first and second members are in said jaw closed position; and said handles being always spaced apart and being located for pivotal movement in parallel planes when said gripping jaws are in said jaw closed position with said second axis being coaxial with said third axis and which said handles are spaced apart from each other sufficient that when said handles are in said respective folded positions they receive said gripping jaws therebetween when said gripping jaws are in said jaw closed position with each handle serving to block pivotal movement of one of said jaws toward a jaw open position.

2. A tool as set forth in claim 1 wherein said left and right gripping jaws together, when in said jaw closed position, are of a width corresponding with said spacing between said parallel planes.

3. A tool as set forth in claim 2 wherein said left side gripping jaw and said right side gripping jaw have cooperating recesses formed therein so that when said jaws are in a closed position the recesses define an opening, said opening serving to receive and retain a key ring or the like.

4. A tool is set forth in claim 2 wherein said left side tang and said right side tang have cooperating notches formed in facing surfaces of said tangs for use in gripping objects and the like.

5. A tool is set forth in claim 4 wherein each said notch is located between said first pivot means and said second or third pivot means and each said notch has a sharp edge adjacent said first pivot means so that said notches may be used for wire stripping or wire cutting and the like.

6. A tool as set forth in claim 2 wherein each said tang has a blade edge formed thereon with the blade edges of the tangs cooperating together to form a scissor-like tool for cutting objects.

7. A tool as set forth in claim 6 wherein each said tang has an arcuate notch formed therein between, a said blade edge and said first pivot means.

8. A tool as set forth in claim 7 wherein each said handle has screwdriver means formed at said second end.

9. A tool is set forth in claim 7 wherein one of said handles has screwdriver means formed therein for turning a Phillips screw.

10. A tool is set forth in claim 7 wherein one of said handles has screwdriver means formed at said second and for turning a screw.

* * * * *